US009872812B2

(12) United States Patent
Malhi et al.

(10) Patent No.: US 9,872,812 B2
(45) Date of Patent: Jan. 23, 2018

(54) RESIDUAL PRESSURE CONTROL IN A COMPRESSION DEVICE

(71) Applicant: Covidien LP, Mansfield, MA (US)

(72) Inventors: Arnaz Malhi, Watertown, MA (US); Manish Deshpande, Canton, MA (US)

(73) Assignee: KPR U.S., LLC, Mansfield, MA (US)

( * ) Notice: Subject to any disclaimer, the term of this patent is extended or adjusted under 35 U.S.C. 154(b) by 809 days.

(21) Appl. No.: 13/629,925

(22) Filed: Sep. 28, 2012

(65) Prior Publication Data

US 2014/0094725 A1 Apr. 3, 2014

(51) Int. Cl.

| | |
|---|---|
| ***A61H 9/00*** | (2006.01) |
| ***A61H 23/00*** | (2006.01) |
| ***A61H 23/04*** | (2006.01) |

(52) U.S. Cl.

CPC ..... *A61H 9/0078* (2013.01); *A61H 9/00* (2013.01); *A61H 9/005* (2013.01); *A61H 9/0092* (2013.01); *A61H 23/04* (2013.01); *A61H 2201/0103* (2013.01); *A61H 2201/0173* (2013.01); *A61H 2201/1238* (2013.01);

(Continued)

(58) Field of Classification Search

CPC ..... A61H 9/00; A61H 9/0007; A61H 9/005; A61H 9/0078; A61H 9/0092; A61H 2201/00; A61H 2201/0103; A61H 2201/12; A61H 2201/1207; A61H 2201/16; A61H 2201/164; A61H 2201/165; A61H 2201/50; A61H 2201/5002; A61H 2205/10; A61H 2205/106; A61H 2205/108;

(Continued)

(56) References Cited

U.S. PATENT DOCUMENTS

| | | | |
|---|---|---|---|
| 2,261,385 | A | 11/1941 | Kaminsky et al. |
| 2,569,795 | A | 10/1951 | Avery |

(Continued)

FOREIGN PATENT DOCUMENTS

| | | | |
|---|---|---|---|
| DE | 19846922 | A1 | 4/2000 |
| EP | 0388200 | A2 | 9/1990 |

(Continued)

OTHER PUBLICATIONS

European Search Report dated Jan. 23, 2014 in related EP patent application 13178730.1, 7 pages.

(Continued)

*Primary Examiner* — Justine Yu
*Assistant Examiner* — Tu Vo
(74) *Attorney, Agent, or Firm* — Nicole M. Creegan

(57) ABSTRACT

A method of controlling a compression device controls a vent phase of a compression device having an inflatable bladder capable of being pressurized for applying compression to a part of a subject's body. The method includes delivering pressurized fluid from a source of pressurized fluid to a first inflatable bladder disposed about a portion of the subject's body and venting the pressurized fluid from the first inflatable bladder by opening a first valve. The method further includes monitoring fluid pressure in the first inflatable bladder during the venting of the first inflatable bladder. Based at least in part on the monitored fluid pressure, the first valve is selectively closed and selectively reopened to control fluid pressure in the first inflatable bladder to remain within a desired residual pressure range.

9 Claims, 9 Drawing Sheets

(52) U.S. Cl.
CPC ..... *A61H 2201/1409* (2013.01); *A61H 2201/165* (2013.01); *A61H 2201/5002* (2013.01); *A61H 2201/5007* (2013.01); *A61H 2201/5038* (2013.01); *A61H 2201/5071* (2013.01); *A61H 2205/106* (2013.01); *A61H 2205/12* (2013.01)

(58) Field of Classification Search
CPC ..... A61H 2205/12; A61H 2209/00; A61H 2205/00; A61F 5/05816
See application file for complete search history.

(56) References Cited

U.S. PATENT DOCUMENTS 2,669,987 A 2/1954 Tonkin
2,694,395 A 11/1954 Brown
2,823,668 A 2/1958 Van Court et al.
3,094,116 A 6/1963 Logan et al.
3,094,118 A 6/1963 De Besme et al.
3,164,152 A 1/1965 Vere Nicoll
3,179,106 A 4/1965 Meredith
3,245,405 A 4/1966 Gardner
3,307,533 A 3/1967 Meredith et al.
3,312,213 A 4/1967 Timm
3,454,010 A 7/1969 Lilligren et al.
3,472,233 A 10/1969 Sarbacher
3,536,063 A 10/1970 Werding
3,561,435 A 2/1971 Nicholson
3,654,919 A 4/1972 Birtwell
3,728,875 A 4/1973 Hartigan et al.
3,786,805 A 1/1974 Tourin
3,811,431 A 5/1974 Apstein
3,826,249 A 7/1974 Lee et al.
3,866,604 A * 2/1975 Curless et al. ..... 601/152
3,871,381 A 3/1975 Roslonski
3,877,426 A 4/1975 Nirschl
3,892,229 A 7/1975 Taylor et al.
3,901,221 A 8/1975 Nicholson et al.
3,920,006 A 11/1975 Lapidus
3,924,613 A 12/1975 Beck
3,942,518 A * 3/1976 Tenteris et al. ..... 601/150
3,982,531 A 9/1976 Shaffer
3,993,053 A 11/1976 Grossan
4,013,069 A 3/1977 Hasty
4,029,087 A 6/1977 Dye et al.
4,030,488 A 6/1977 Hasty
4,054,129 A 10/1977 Byars et al.
4,057,046 A 11/1977 Kawaguchi
4,066,084 A 1/1978 Tillander
4,077,402 A 3/1978 Benjamin, Jr. et al.
4,086,920 A 5/1978 Miniere
4,091,804 A 5/1978 Hasty
4,106,002 A 8/1978 Hogue, Jr.
4,112,943 A 9/1978 Adams
4,156,425 A 5/1979 Arkans
4,157,087 A 6/1979 Miller et al.
4,178,923 A 12/1979 Curlee
4,198,961 A 4/1980 Arkans
4,202,312 A 5/1980 Mori et al.
4,202,325 A 5/1980 Villari et al.
4,206,751 A 6/1980 Schneider
4,207,875 A 6/1980 Arkans
4,207,876 A 6/1980 Annis
4,253,449 A 3/1981 Arkans et al.
4,280,485 A 7/1981 Arkans
4,311,135 A 1/1982 Brueckner et al.
4,320,746 A 3/1982 Arkans et al.
4,372,297 A 2/1983 Perlin
4,374,518 A 2/1983 Villanueva
4,375,217 A 3/1983 Arkans
4,396,010 A 8/1983 Arkans
4,408,599 A 10/1983 Mummert
4,419,988 A 12/1983 Mummert
4,442,834 A 4/1984 Tucker et al.
4,453,538 A 6/1984 Whitney
4,469,099 A 9/1984 McEwen
4,501,280 A 2/1985 Hood, Jr.
4,531,516 A 7/1985 Poole et al.
4,552,132 A 11/1985 Ruscigno
4,577,626 A 3/1986 Marukawa et al.
4,580,816 A 4/1986 Campbell et al.
4,583,255 A 4/1986 Mogaki et al.
4,583,522 A 4/1986 Aronne
4,597,384 A 7/1986 Whitney
4,614,180 A 9/1986 Gardner et al.
4,624,244 A 11/1986 Taheri
4,696,289 A 9/1987 Gardner et al.
4,702,232 A 10/1987 Gardner et al.
4,721,101 A 1/1988 Gardner et al.
4,722,332 A 2/1988 Saggers
4,730,606 A 3/1988 Leininger
4,747,398 A 5/1988 Wright
4,762,121 A 8/1988 Shienfeld
4,785,813 A 11/1988 Petrofsky
4,796,631 A 1/1989 Grigoryev
4,809,684 A 3/1989 Gardner et al.
4,827,912 A 5/1989 Carrington et al.
RE32,939 E 6/1989 Gardner et al.
RE32,940 E 6/1989 Gardner et al.
D302,301 S 7/1989 Robinette-Lehman
4,858,596 A 8/1989 Kolstedt et al.
4,865,020 A 9/1989 Bullard
4,883,073 A 11/1989 Aziz
4,938,208 A 7/1990 Dye
4,947,834 A 8/1990 Kartheus et al.
4,981,131 A 1/1991 Hazard
4,986,260 A 1/1991 Iams et al.
5,003,981 A 4/1991 Kankkunen et al.
5,007,411 A 4/1991 Dye
5,014,681 A 5/1991 Neeman et al.
5,022,387 A 6/1991 Hasty
5,027,797 A 7/1991 Bullard
5,031,604 A 7/1991 Dye
5,050,613 A 9/1991 Newman et al.
5,052,377 A 10/1991 Frajdenrajch
5,056,505 A * 10/1991 Warwick ..... A61H 9/0078 601/44
5,060,654 A 10/1991 Malkamäki et al.
5,062,414 A 11/1991 Grim
5,094,252 A 3/1992 Stumpf
5,109,832 A 5/1992 Proctor et al.
5,117,812 A 6/1992 McWhorter
5,167,235 A 12/1992 Seacord et al.
5,186,163 A 2/1993 Dye
5,199,436 A 4/1993 Pompei et al.
5,218,954 A 6/1993 van Bemmelen
5,230,335 A 7/1993 Johnson, Jr. et al.
5,254,087 A 10/1993 McEwen
5,263,473 A 11/1993 McWhorter
5,277,695 A 1/1994 Johnson, Jr. et al.
5,288,286 A 2/1994 Davis et al.
5,301,676 A 4/1994 Rantala et al.
5,307,791 A 5/1994 Senoue et al.
5,314,455 A 5/1994 Johnson, Jr. et al.
5,319,202 A 6/1994 Pompei
5,342,410 A 8/1994 Braverman
5,354,260 A 10/1994 Cook
5,368,547 A 11/1994 Polando
5,381,796 A 1/1995 Pompei
5,383,894 A 1/1995 Dye
5,389,065 A 2/1995 Johnson, Jr.
5,396,896 A 3/1995 Tumey et al.
5,407,421 A 4/1995 Goldsmith
D358,216 S 5/1995 Dye
5,435,009 A 7/1995 Schild et al.
5,437,610 A 8/1995 Cariapa et al.
5,441,533 A 8/1995 Johnson et al.
5,443,440 A 8/1995 Tumey et al.
5,466,250 A 11/1995 Johnson, Jr. et al.
5,469,855 A 11/1995 Pompei et al.
5,487,759 A 1/1996 Bastyr et al.
5,489,252 A 2/1996 May
5,489,259 A 2/1996 Jacobs et al.

(56) References Cited

U.S. PATENT DOCUMENTS 5,496,262 A 3/1996 Johnson, Jr. et al.
5,502,377 A 3/1996 Freund
5,514,081 A 5/1996 Mann
5,517,999 A 5/1996 Newell
5,524,087 A 6/1996 Kawamura et al.
5,556,415 A 9/1996 McEwen et al.
5,558,627 A 9/1996 Singer et al.
5,562,604 A 10/1996 Yablon et al.
5,566,677 A 10/1996 Raines et al.
D376,013 S 11/1996 Sandman et al.
5,575,762 A 11/1996 Peeler et al.
5,584,798 A 12/1996 Fox
5,588,955 A 12/1996 Johnson, Jr. et al.
5,591,200 A 1/1997 Cone et al.
5,607,447 A 3/1997 McEwen et al.
5,626,556 A 5/1997 Tobler et al.
5,628,722 A 5/1997 Solomonow et al.
5,630,424 A 5/1997 Raines et al.
5,634,889 A 6/1997 Gardner et al.
5,643,332 A 7/1997 Stein
5,653,244 A 8/1997 Shaw
D384,159 S 9/1997 Tsai
5,669,872 A 9/1997 Fox
5,674,262 A 10/1997 Tumey
5,676,639 A 10/1997 Schild
5,681,339 A 10/1997 McEwen et al.
5,704,363 A 1/1998 Amano
5,711,757 A 1/1998 Bryant
5,711,760 A 1/1998 Ibrahim et al.
5,713,954 A 2/1998 Rosenberg et al.
5,715,828 A 2/1998 Raines et al.
5,718,232 A 2/1998 Raines et al.
5,769,797 A 6/1998 Van Brunt et al.
5,769,801 A 6/1998 Tumey et al.
5,782,893 A 7/1998 Dennis, III
D397,225 S 8/1998 Lange et al.
5,792,109 A 8/1998 Ladd
5,795,312 A 8/1998 Dye
5,827,209 A 10/1998 Gross
5,833,639 A 11/1998 Nunes et al.
5,840,049 A * 11/1998 Tumey ..... A61H 9/0078 137/856
5,843,007 A 12/1998 McEwen et al.
5,855,589 A 1/1999 McEwen et al.
5,876,359 A * 3/1999 Bock et al. ..... 601/150
5,891,065 A 4/1999 Cariapa et al.
5,894,271 A 4/1999 Cleveland et al.
D411,301 S 6/1999 Hampson et al.
5,931,853 A 8/1999 McEwen et al.
5,951,502 A 9/1999 Peeler et al.
5,968,073 A 10/1999 Jacobs
5,988,704 A 11/1999 Ryhman
5,989,204 A 11/1999 Lina
5,991,654 A 11/1999 Tuney et al.
6,001,119 A 12/1999 Hampson et al.
6,007,559 A 12/1999 Arkans
6,010,470 A 1/2000 Albery et al.
6,015,394 A 1/2000 Young
6,021,800 A 2/2000 Schild et al.
6,051,016 A 4/2000 Mesaros et al.
6,080,120 A 6/2000 Sandman et al.
6,123,681 A 9/2000 Brown, III
D432,240 S 10/2000 Katz et al.
6,129,688 A 10/2000 Arkans
6,135,116 A 10/2000 Vogel et al.
6,135,974 A 10/2000 Matz
6,149,674 A 11/2000 Borders
6,152,495 A 11/2000 Hoffmann et al.
6,152,893 A 11/2000 Pigg et al.
6,155,995 A 12/2000 Lin
6,171,254 B1 1/2001 Skelton
6,202,684 B1 3/2001 Angel et al.
6,203,510 B1 3/2001 Takeuchi et al.
6,231,532 B1 * 5/2001 Watson et al. ..... 601/150
6,257,626 B1 7/2001 Campau
6,257,627 B1 7/2001 Fujiwara et al.
6,290,662 B1 9/2001 Morris et al.
6,315,745 B1 11/2001 Kloecker
6,319,215 B1 11/2001 Manor et al.
6,322,530 B1 11/2001 Johnson, Jr. et al.
D452,570 S 12/2001 Since
6,336,907 B1 1/2002 Dono et al.
6,355,008 B1 3/2002 Nakao
6,358,219 B1 3/2002 Arkans
6,361,512 B1 3/2002 Mackay et al.
6,368,357 B1 4/2002 Schon et al.
6,387,064 B1 5/2002 Gunnon
6,387,065 B1 5/2002 Tumey
D459,479 S 6/2002 Perricone
D459,816 S 7/2002 Perricone
6,421,859 B1 7/2002 Hicks et al.
6,423,053 B1 7/2002 Lee
6,436,064 B1 8/2002 Kloecker
6,440,093 B1 8/2002 McEwen et al.
6,447,460 B1 9/2002 Zheng et al.
6,450,966 B1 9/2002 Hanna
6,450,981 B1 9/2002 Shabty et al.
6,463,934 B1 10/2002 Johnson, Jr. et al.
6,464,654 B1 10/2002 Montgomery et al.
6,468,237 B1 10/2002 Lina
6,477,410 B1 11/2002 Henley et al.
6,478,757 B1 11/2002 Barak
6,488,643 B1 12/2002 Tumey et al.
6,493,568 B1 12/2002 Bell et al.
6,494,852 B1 12/2002 Barak et al.
6,514,200 B1 2/2003 Khouri
D473,314 S 4/2003 Since
6,544,202 B2 4/2003 McEwen et al.
6,544,203 B2 4/2003 Hazard
6,557,704 B1 5/2003 Randolph
6,572,621 B1 6/2003 Zheng et al.
6,589,267 B1 7/2003 Hui
6,589,268 B1 7/2003 McEwen
6,589,534 B1 7/2003 Shaul et al.
6,592,534 B1 7/2003 Rutt et al.
6,629,941 B1 10/2003 Ishibashi et al.
6,689,074 B2 2/2004 Seto et al.
6,736,787 B1 5/2004 McEwen et al.
6,786,879 B1 9/2004 Bolam et al.
6,852,089 B2 2/2005 Kloecker et al.
6,884,255 B1 4/2005 Newton
6,962,599 B2 11/2005 Hui
D520,963 S 5/2006 Krauss
7,048,702 B2 5/2006 Hui
7,076,993 B2 7/2006 Cook
7,115,104 B2 10/2006 Van Brunt et al.
7,166,123 B2 1/2007 Hovanes et al.
7,204,809 B2 4/2007 Hung
7,207,959 B1 4/2007 Chandran
7,270,642 B2 9/2007 Ouchene et al.
8,182,437 B2 * 5/2012 Gasbarro et al. ..... 601/150
8,591,439 B1 * 11/2013 Flood et al. ..... 601/41
8,597,194 B2 * 12/2013 Barak ..... 600/485
2001/0000262 A1 4/2001 McEwen et al.
2001/0020143 A1 9/2001 Stark et al.
2002/0042583 A1 * 4/2002 Barak et al. ..... 601/1
2002/0042584 A1 4/2002 Rue
2002/0068886 A1 6/2002 Lin
2002/0069731 A1 6/2002 Soucy
2002/0107461 A1 * 8/2002 Hui ..... 601/149
2002/0133106 A1 9/2002 Peled
2002/0173735 A1 11/2002 Lewis
2003/0139696 A1 7/2003 Boukanov et al.
2004/0106885 A1 6/2004 Shabty et al.
2005/0075531 A1 4/2005 Loeb et al.
2005/0143682 A1 6/2005 Cook et al.
2005/0154336 A1 7/2005 Kloecker et al.
2005/0159690 A1 7/2005 Barak et al.
2005/0187500 A1 8/2005 Perry et al.
2005/0187501 A1 8/2005 Ravikumar
2005/0187503 A1 8/2005 Tordella et al.
2005/0222526 A1 10/2005 Perry et al.
2006/0058716 A1 * 3/2006 Hui et al. ..... 601/152
2006/0074362 A1 4/2006 Rousso et al.

(56) References Cited

U.S. PATENT DOCUMENTS

| | | | | |
|---|---|---|---|---|
| 2006/0143682 | A1 | 6/2006 | Baekeland et al. | |
| 2006/0149171 | A1* | 7/2006 | Vogel | A61F 13/069 601/11 |
| 2006/0163506 | A1 | 7/2006 | Cook et al. | |
| 2006/0167389 | A1 | 7/2006 | Evans et al. | |
| 2006/0167492 | A1 | 7/2006 | Prince | |
| 2006/0224181 | A1 | 10/2006 | McEwen et al. | |
| 2007/0049853 | A1 | 3/2007 | Adams et al. | |
| 2007/0249977 | A1 | 10/2007 | Bonnefin et al. | |
| 2008/0132816 | A1* | 6/2008 | Kane | A61H 7/001 601/152 |
| 2008/0262396 | A1* | 10/2008 | Biggie | A61H 9/0078 601/56 |
| 2009/0076423 | A1 | 3/2009 | Reeves et al. | |
| 2010/0249679 | A1 | 9/2010 | Perry et al. | |

FOREIGN PATENT DOCUMENTS

| | | | |
|---|---|---|---|
| GB | 2452666 | A | 3/2009 |
| JP | 63-309261 | | 12/1988 |
| JP | 2011024938 | A | 2/2011 |
| WO | 200049968 | A2 | 8/2000 |
| WO | 2005082314 | A1 | 9/2005 |
| WO | 2012051244 | A1 | 4/2012 |

OTHER PUBLICATIONS

TYCO Healthcare Kendall, SCD Response Catalog, Mar. 2000, pp. 1-2.
TYCO Healthcare Kendall, SCD Soft Sleeve Catalog, Apr. 2001, pp. 1-2.
The Kendall Company, Vascular Therapy Products Catalog, Jan. 1996, pp. 8-5 through 8-7.
The Kendall Company, The New SCD Compression Sleeve, Aug. 1993, pp. 1-2.
TYCO Healthcare Kendall, Prevention Gets Personal, Mar. 2001, pp. 1, 2 and 4.
Kendall SCD, Sequential Compression Sleeves, Patent Information, Jan. 1993, 6 pgs.
Patent Examination Report No. 1 dated Jul. 16, 2014 in related Australian Patent Application 2013213766, 3 pages.
Japanese Office Action dated Jul. 28, 2014 in related Japanese patent application 2013-171384, 9 pages.
Korean Office Action dated Aug. 26, 2014 in related patent application 10-2013-115125, 5 pages.
Canadian Office Action dated Oct. 14, 2014 in related patent application 2,822,445, 3 pages.
Office Action dated Jul. 8, 2015 in related Canadian Patent Application No. 2,822,445, 3 pages.
Chinese Office Action dated Feb. 28, 2015 in related patent application 201310423162.1, 15 pages.
Office Action dated Sep. 25, 2015 in related Chinese Patent Application No. 201310423162.1, 14 pages.
Office Action dated Mar. 2, 2016 in related Chinese Patent Application No. 201310423162.1, 9 pages.
Office Action dated Mar. 16, 2016 in related Japanese Application No. 2015-94045, 13 pages.
Office Action dated Jul. 19, 2016 in related Japanese Application No. 2015-094045, 13 pages.
Office Action dated Jul. 29, 2016 in related Chinese Application No. 201310423162.1, 9 pages.
Office Action dated Jul. 8, 2016 in related European Application No. 13178730.1, 5 pages.
Office Action dated Mar. 30, 2017 in related Chinese Application No. 201310423162.1, 10 pages.

* cited by examiner

RESIDUAL PRESSURE CONTROL IN A COMPRESSION DEVICE

TECHNICAL FIELD

The present disclosure generally relates to pressure control and, more specifically, to controlling residual pressure in a bladder of a compression device.

BACKGROUND

The pooling of blood or stasis in a patient's extremities, particularly the legs, can occur when the patient is confined to bed for an extended period of time. Stasis is problematic because it is a significant cause leading to the formation of thrombi. To prevent this occurrence, it is desirable to move fluid out of interstitial spaces in the extremity tissues to enhance circulation.

Intermittent pneumatic compression (IPC) devices are used to improve circulation and minimize the formation of thrombi in the limbs of patients. These devices typically include a compression sleeve or garment having one or more inflatable bladders to provide a compressive pulse or compression therapy to the limb.

Pneumatic compression therapy is usually provided by a pneumatic pump and valves that control the flow of air into and out of specific bladders. Typically, inflation of the bladders is controlled by a microprocessor of the compression device to reach a set pressure providing the requisite therapeutic effect. Once the set pressure is reached, the bladders are usually vented until they reach ambient pressure.

SUMMARY

In one aspect, a method of controlling a compression device controls a vent phase of a compression device having an inflatable bladder capable of being pressurized for applying compression to a part of a subject's body. The method includes delivering pressurized fluid from a source of pressurized fluid to a first inflatable bladder disposed about a portion of the subject's body and venting the pressurized fluid from the first inflatable bladder by opening a first valve. The method further includes monitoring fluid pressure in the first inflatable bladder during the venting of the first inflatable bladder. Based at least in part on the monitored fluid pressure, the first valve is selectively closed and selectively reopened to control fluid pressure in the first inflatable bladder to remain within a desired residual pressure range.

In another aspect, a method of controlling a compression device includes controlling a vent phase of a compression device including an inflatable bladder capable of being pressurized for applying compression to apart of a subject's body. The method includes delivering pressurized fluid from a source of pressurized fluid to an inflatable bladder disposed about a portion of a subject's body and venting pressurized fluid from the inflatable bladder by partially opening a proportional valve. The method further includes monitoring fluid pressure in the inflatable bladder during the venting. Based at least in part on the monitored fluid pressure in the inflatable bladder, the proportional valve is closed when fluid pressure in the inflatable bladder is within a desired residual pressure range.

In yet another aspect, a compression device for applying compression treatment to a subject's body part, the device includes a controller, a first inflatable bladder in fluid communication with the first inflatable bladder, and a first 3-way/2-position, normally open, valve in fluid communication with the first inflatable bladder. The controller is configured to supply pressurized fluid, which is receivable by the first inflatable bladder. The first valve is actuatable by the controller to control venting of the pressurized fluid from the first inflatable bladder.

In still another aspect, a compression device for applying compression treatment to a subject's body part, the device includes a controller, a plurality of inflatable bladders, and a plurality of valves. The controller is configured to supply pressurized fluid. The plurality of inflatable bladders is in fluid communication with the controller, and the pressurized fluid from the controller is receivable by each of the plurality of inflatable bladders. Each of the plurality of valves is in fluid communication with a respective inflatable bladder. Less than all of the plurality of valves vents fluid from the plurality of inflatable bladders. This configuration can, for example, reduce the number of valves required to vent the bladders and, thus, reduce the overall size of the compression device.

In one or more aspects, a manifold can be in fluid communication with each bladder, and a single pressure transducer can be in fluid communication with the manifold for measuring a fluid pressure in each bladder. In some aspects, a check valve can be upstream from and in fluid communication with the manifold. Additionally or alternatively, in certain aspects, the manifold can define a fail-safe orifice.

Embodiments can include one or more of the following advantages.

In some embodiments, methods of controlling the vent phase of a compression device include selectively closing and selectively reopening a valve, based at least in part on measured fluid pressure in a bladder, to control fluid pressure in the bladder to remain with a desired residual pressure range (e.g., a pressure range above ambient pressure and below a compression pressure for treating the subject). Such control of fluid within the bladder during the vent phase can, for example, reduce the amount of fluid (e.g., air) needed to inflate the bladder during a subsequent phase of treatment. Reducing the amount of fluid needed to inflate the bladder can reduce the total cycle time of the compression and venting process to facilitate improved treatment of the portion of the subject's body. Additionally or alternatively, reducing the amount of fluid needed to inflate the bladder can reduce the size of the air supply associated with inflating the bladder, which can facilitate, for example, portability of the compression device and/or reduce the amount of space taken by the compression device in the vicinity of the subject.

In certain embodiments, methods of controlling the vent phase of compression device include controlling one or more valves to control the residual pressure in one or more bladders. In some implementations, such control of the residual pressure in three bladders can facilitate the use of a gradient of residual pressures in the three bladders. For example, a first bladder positionable about an ankle of the subject can have a residual pressure of about 4 mmHg, a second bladder positionable about a calf of the subject can have a residual pressure of about 2 mmHg, and a third bladder positionable about a thigh of the subject can have a residual pressure of about 0 mm Hg. Such a gradient in residual pressures can reduce the respective inflation times and/or the respective inflation volumes of each of the bladders as the bladders are inflated to apply a gradient of compression pressures to the subject.

Other objects and features will be apparent from the description and drawings, and from the claims.

BRIEF DESCRIPTION OF THE DRAWINGS

Corresponding reference characters indicate corresponding parts throughout the drawings.

DETAILED DESCRIPTION

Figure 1:
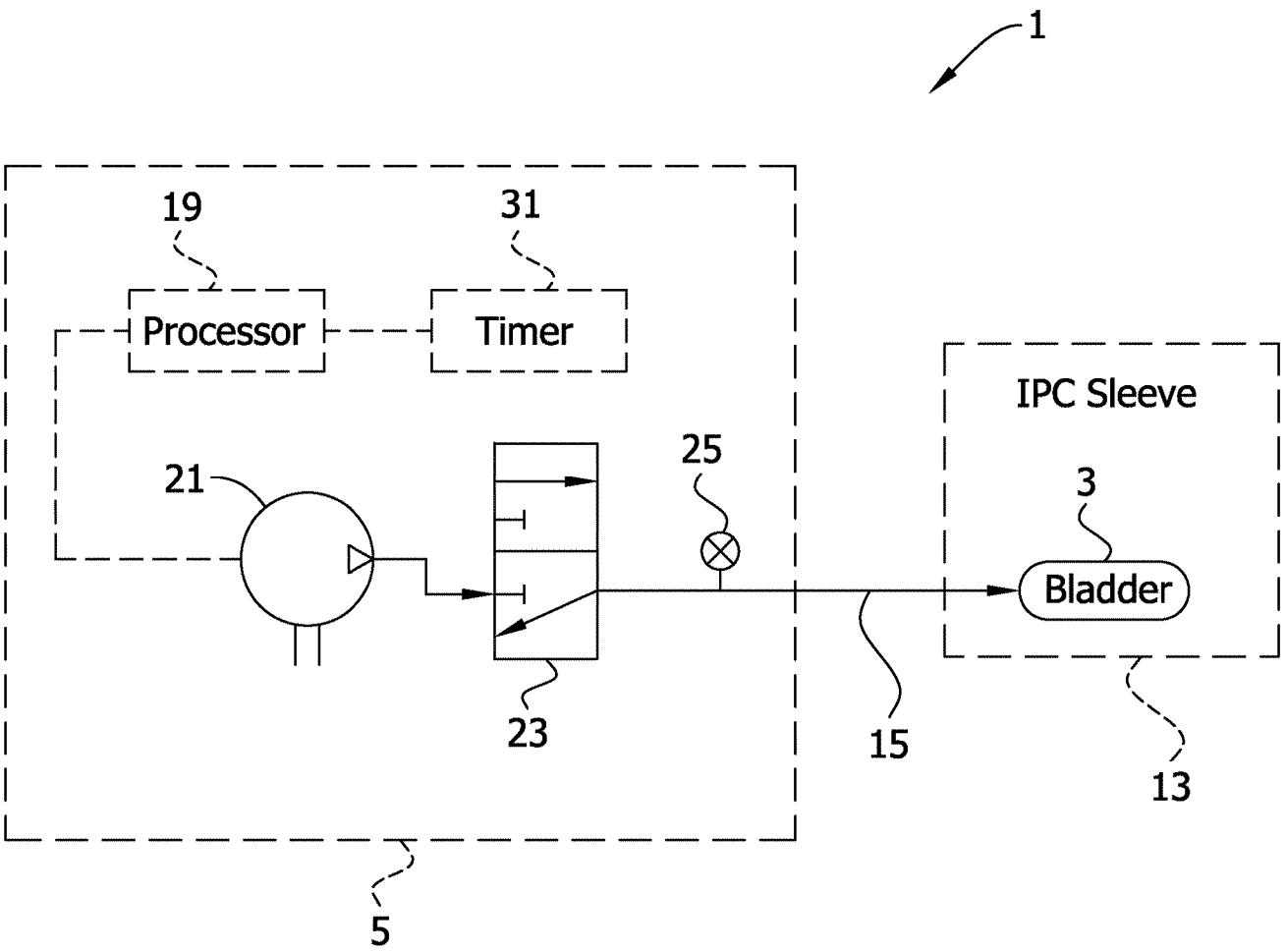
FIG. 1 is a schematic of a compression device.

Referring to FIG. 1, a pneumatic circuit of an intermittent pneumatic compression (IPC) device 1 includes a bladder 3 and a controller 5 for controlling a residual pressure in the bladder. In the IPC device 1, a compression sleeve 13 including the bladder 3 is connected, for example, via tubing 15, to the controller 5 having a processor 19 operatively connected to an air supply 21 (e.g., a compressor) that provides compressed air to the bladder. A valve 23 is provided between the sleeve 13 and the air supply 21. A pressure transducer 25, downstream from the valve 23, monitors the pressure in the bladder 3. The transducer 25 may be connected directly to the bladder 3 or a manifold (not shown) in communication with the bladder. The sleeve 13 can have two or more bladders. For example, the sleeve 113 shown in FIG. 3 has three bladders.

Figure 9:
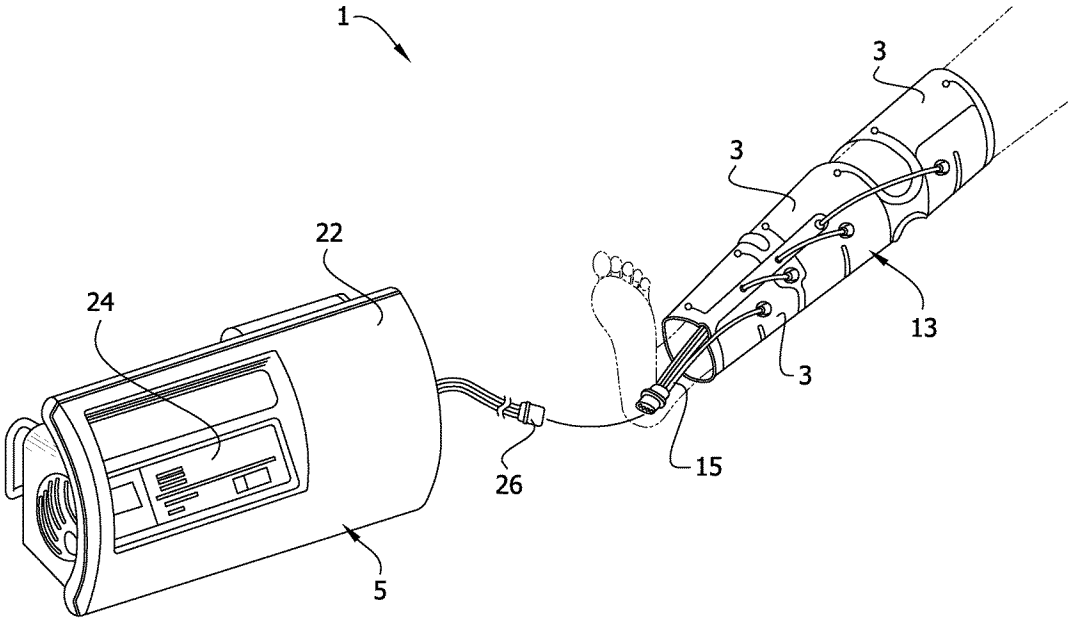
FIG. 9 is a perspective of a controller and compression sleeve.

Referring now to FIGS. 1 and 9, the controller 5 is disposed in a housing 22. A control panel 24 on the housing 22 includes controls and indicators, for example, for inputting parameters to the controller 5. An output connector 26 is positioned on the housing 22 and is engageable with the tubing 15 for connecting the controller 5 and the air supply 21 to the sleeve 13. The sleeve 13 includes three bladders 3 that, in use, apply compression to the subject's ankle, calf, and thigh, respectively. It should be appreciated that the sleeve 13 can include fewer or additional bladders, as required for applying a particular compression treatment protocol to a portion (e.g., a limb) of a subject.

The sleeve 13 is configured to be wrapped around a subject's limb (e.g., leg) (FIG. 9). To provide a compressive pulse to the limb, the controller 5 opens the valve 23 and activates the air supply 21 to provide compressed air to the bladder 3 until the pressure in the bladder reaches a suitable value for operation in a compression cycle. In embodiments in which the sleeves having two or more bladders, sequential compression therapy can be applied to the subject's limb. When pressurization is complete, the air supply 21 is deactivated and the bladder 3 is allowed to depressurize by, for example, venting back through the tubing 15 to the controller 5. Air may be vented to the atmosphere through the valve 23. It may be desirable to retain some pressure (i.e., residual pressure) in the bladder 3 after venting. Controlling residual pressure in the bladder 3 reduces the flow requirement of the device 1, and in particular the air supply 21, by reducing air required for subsequent pressurization. In some embodiments, a desired residual pressure range is between about 0 and about 15 mmHg (e.g., about 1 mmHg and about 10 mmHg).

The processor 19 executes computer-executable instruction to pressurize (e.g., inflate) the bladder 3 to provide compression pressure to a wearer's limb. For example, the processor 19 may execute instructions to pressurize the bladder 3 to a first compression pressure (e.g., 20 mmHg) to move the blood in the limb from a region (e.g., calf) underlying the bladder 3. This phase of the compression cycle is known as the inflation phase. After pressurizing the bladder 3 to the first compression pressure, the processor 19 may execute instructions to reduce the pressure in the bladder to a residual pressure (e.g., 10 mmHg), allowing the blood to reenter the region of the limb underlying the bladder. This phase of the compression cycle is known as the vent phase. During the vent phase, the pressure in the bladder 3 can be sensed by the pressure transducer 25 until the pressure in the bladder reaches a desired residual pressure (e.g., a predetermined residual pressure).

To control the pressure in the bladder 3 during the vent phase, the processor 19 can execute instructions to operate the valve 23 to vent the bladder to the desired residual pressure. For example, the processor 19 can open and close the valve 23 as fluid is being vented from the bladder 3 until the pressure in the bladder is within a predetermined residual pressure range.

Figure 2:
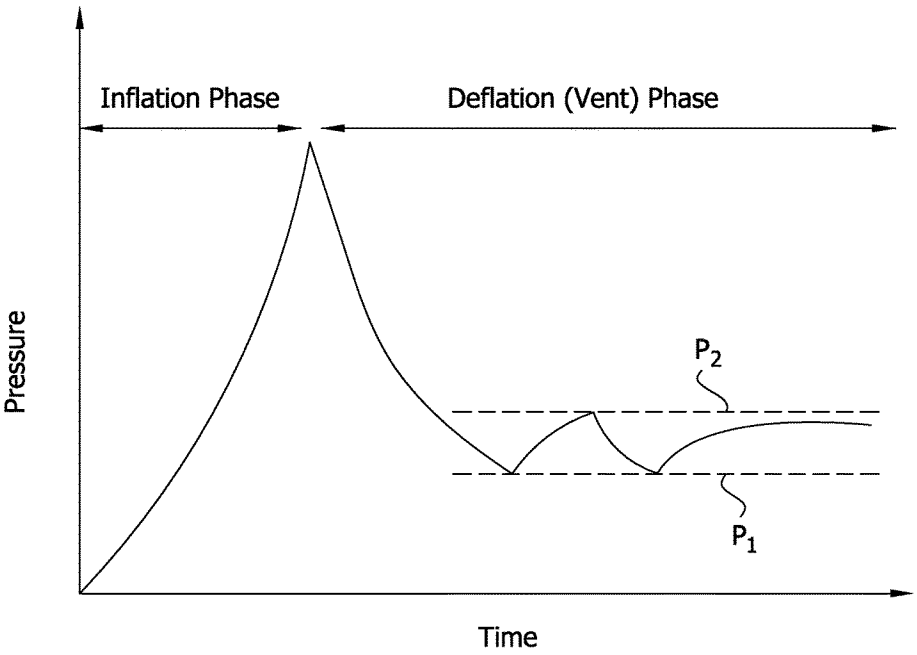
FIG. 2 is a graphical illustration of a pressure profile of the compression device of FIG. 1.

Referring to FIG. 2, once the inflation phase is completed, the processor 19 executes instructions to open the valve 23 and the pressure in the bladder 3 begins to drop, starting the vent phase. Predetermined pressure values $P_1$, $P_2$ can be set such that the valve 23 remains open until the pressure transducer 25 senses pressure in the bladder 3 has reached a bottom range pressure $P_1$ (e.g., the bottom pressure range $P_1$ can be above ambient pressure). When the transducer 25 measures a pressure of $P_1$ or less, the processor 19 executes instructions to close the valve 23, causing the pressure in the bladder 3 to rise. When the pressure transducer 25 senses pressure in the bladder 3 has reached or exceeded a top range pressure $P_2$, the processor 19 executes instructions to open the valve 23, causing the pressure in the bladder to drop. The processor 19 can execute instructions to operate the valve in this manner (i.e., repeatedly opening and closing the valve 23) until the pressure in the bladder 3 levels out within the pressure range between $P_1$ and $P_2$. The processor 19 can also execute instructions to open and close the valve 23 at regular intervals using a timer 31 operatively connected to the processor. For instance, the processor 19 can open and close the valve 23 about every 200 ms until the desired residual pressure is maintained in the bladder 3. Although FIG. 2 illustrates residual pressure as a function of time for a single bladder, it will be understood that the process can be used in compression devices having multiple bladders.

Figure 3:
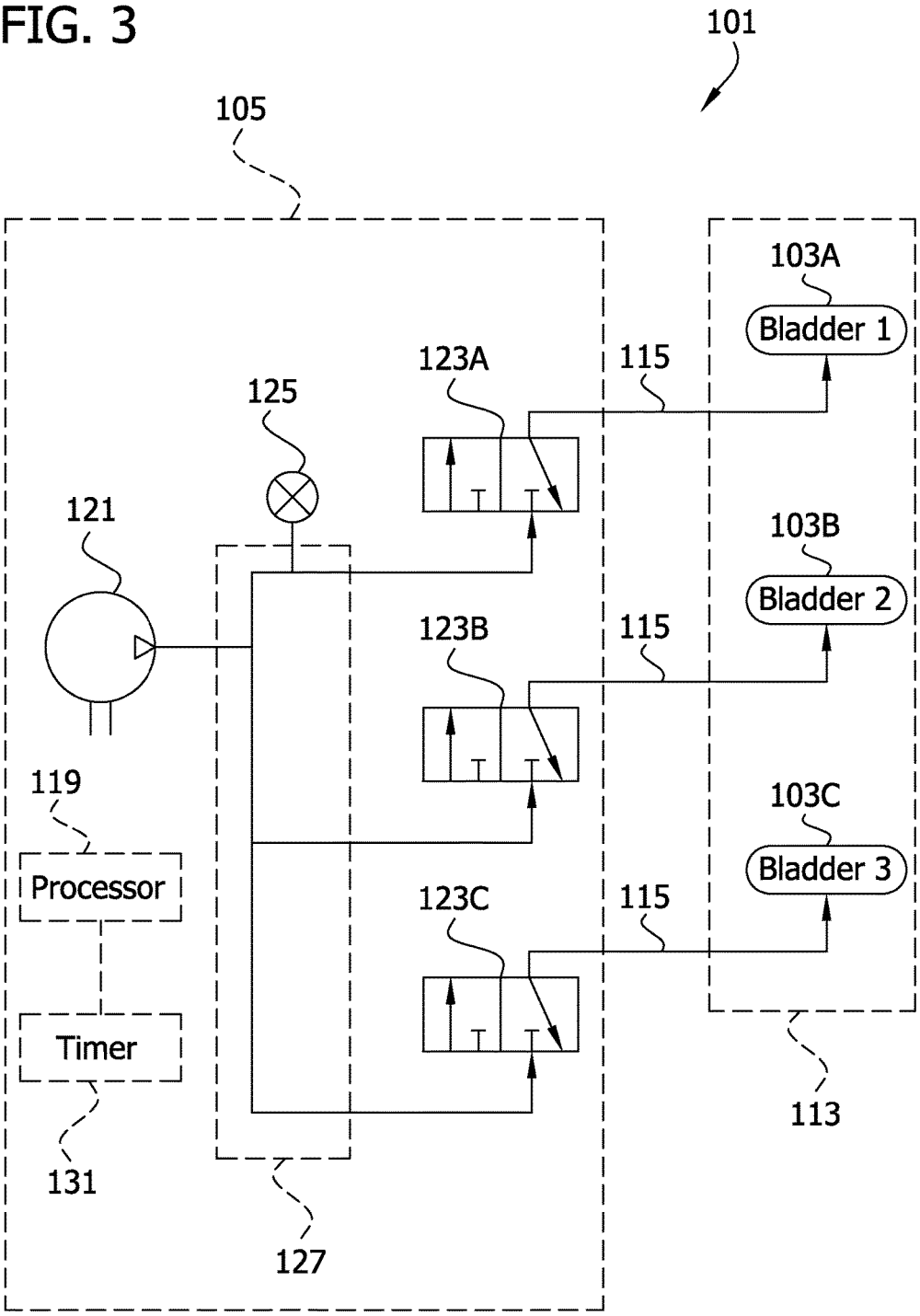
FIG. 3 is a schematic of a compression device including bladders each having dedicated valves.

Referring to FIG. 3, a pneumatic circuit 101 includes three bladders 103A, 103B, 103C, each in fluid communication with a dedicated valve 123A, 123B, 123C. Parts of the circuit 101 generally corresponding to those of the circuit 1 will be given the same number, plus "100." A single pressure transducer 125 fluidly communicates with a manifold 127 in communication with the bladders 103A, 103B, 103C. An air supply 121 delivers compressed air to the bladders 103A, 103B, 103C through tubing 115. The circuit 101 can vent the bladders 103A, 103B, 103C to a desired residual pressure as described above. For example, each time the valves are opened, the pressure transducer 125 measures pressure in the corresponding bladder until the targeted residual pressure is reached. Each valve 123A, 123B, 123C is a 3-way/2-position, normally closed, solenoid valve. Each of these valves includes three ports and is actuatable to place a first port (i.e., inlet port) in fluid communication with a second port (i.e., bladder port) in a first position. Each valve is further actuatable to place the second port in fluid communication with a third port (i.e., vent port) in a second position. The first port of each valve 123A, 123B, 123C is in fluid communication with the air supply 121. The second port of each valve 123A, 123B, 123C is in fluid communication with a respective bladder 103A, 103B, 103C and the third port is in fluid communication with ambient atmosphere. The valves 123A, 123E, 123C could also be other types.

The pressure in each bladder 103A, 103B, 103C can be controlled to a common or different residual pressure. To control each bladder to a common residual pressure, the controller 105 vents the bladders 103A, 103B, 103C at the same time to produce a uniform pressure at the manifold 127. The manifold pressure is controlled by opening and closing the valves 123A, 123B, 123C simultaneously until the targeted residual pressure is reached.

The pressure in each bladder 103A, 103B, 103C can be controlled to different residual pressures. To control the pressures in the bladders 103A, 103B, 103C to different residual pressures, the controller 105 vents each bladder separately (for example, the controller can control the process of opening and closing each valve separately). This can, for example, facilitate the use of a single pressure transducer to monitor pressure in each bladder 103A, 103B, 103C.

In some embodiments, the controller 105 sequentially vents the bladders 103A, 103B, 103C to respective residual pressures. In such embodiments, a first bladder 103A is vented by repeatedly opening and closing the corresponding valve 123A. The pressure transducer 125 measures the pressure in the manifold 127 corresponding to the first bladder 103A and the bladder is vented until the pressure reaches a desired residual pressure for the first bladder at which time the valve 123A is closed. The controller 105 then indexes to a second bladder 103B and vents the second bladder until the pressure in the manifold 127 reaches a desired residual pressure for the second bladder. Finally, the controller 105 indexes to a third bladder 103C and vents the third bladder until the pressure in the manifold 127 reaches a desired residual pressure for the third bladder. The controller 105 can index between bladders 103A, 103B, 103C prior to the targeted residual pressure being reached in any of the bladders. The controller 105 can also sequentially vent each bladder 103A, 103B, 103C to the same or different residual pressure. Additionally or alternatively, the controller 105 can index between the bladders 103A, 103B, 103C in non-sequential order.

Figure 4:
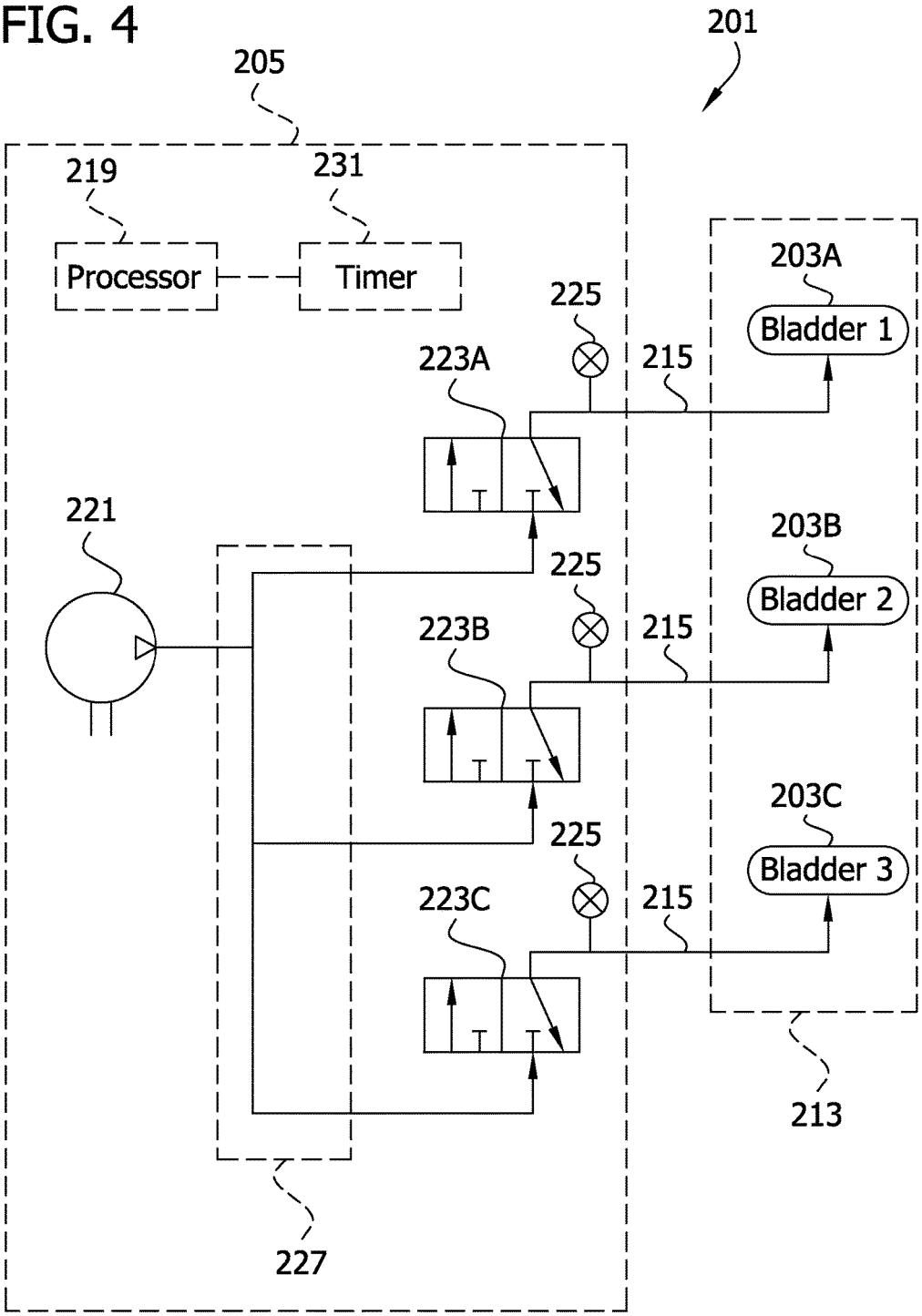
FIG. 4 is a schematic of a compression device including bladders each having dedicated valves and dedicated pressure transducers.

Referring to FIG. 4, a pneumatic circuit 201 is similar to the circuit 101 (FIG. 3) except each bladder 203A, 203B, 203C has a dedicated valve 223A, 223B, 223C and a dedicated pressure transducer 225A, 225B, 225C, respectively. Parts of the circuit 201 generally corresponding to those of the circuit 1 will be given the same number, plus "200."

Each bladder 203A, 203B, 203C can be controlled to a desired residual pressure using pressure readings from each dedicated pressure transducer 225A, 225B, 225C. Having a dedicated pressure transducer can also allow the controller 205 to simultaneously vent each bladder 203A, 203B, 203C to a common or different residual pressure.

Figure 5:
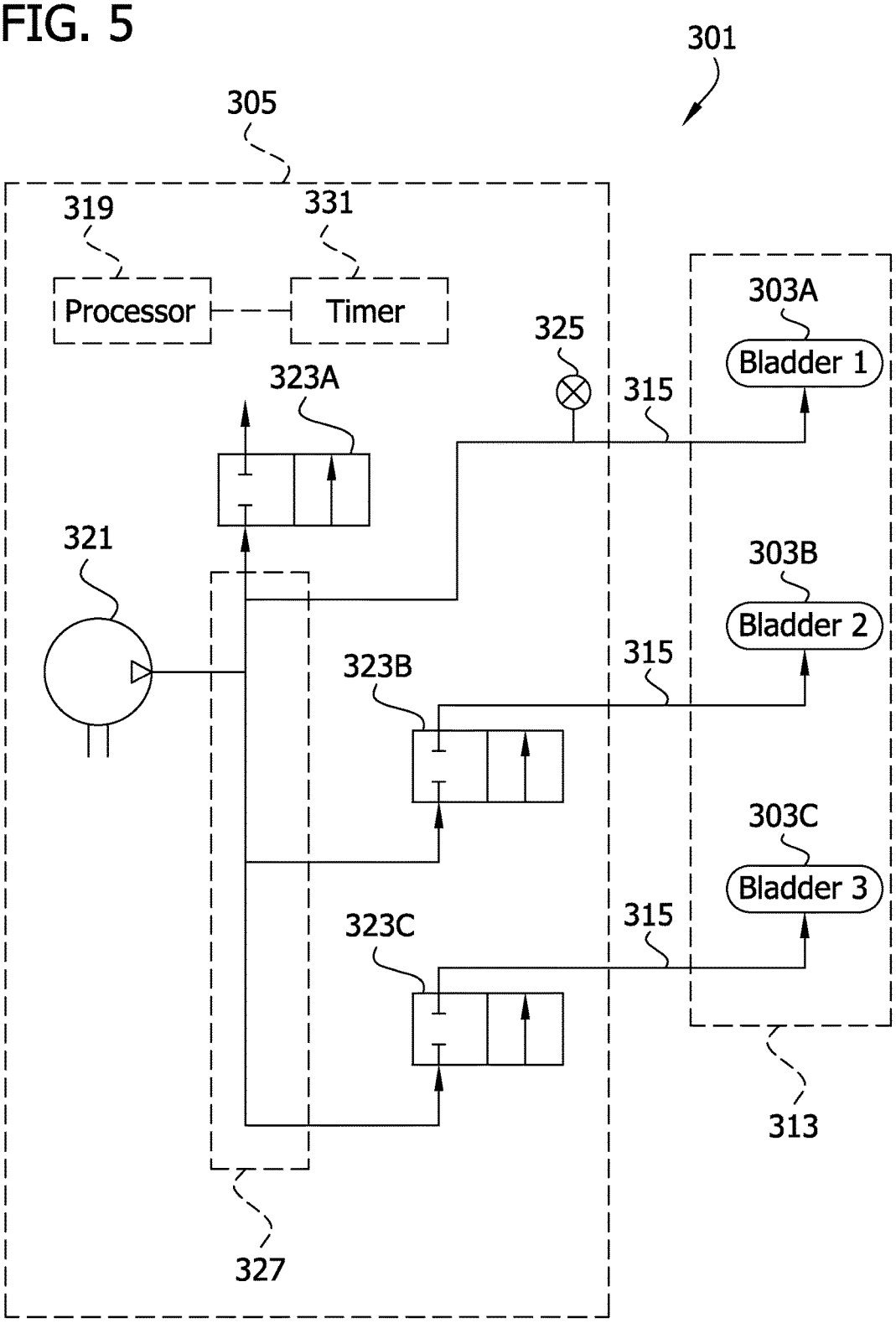
FIG. 5 is a schematic of a compression device including a valve controlling pressure in a common manifold and dedicated valves for certain bladders.

Referring to FIG. 5, a pneumatic circuit 301 includes a first valve 323A controlling the pressure in a common manifold 327, a second valve 332B dedicated to a second bladder 303B, and a third valve 323C dedicated to a third bladder 303C. A single pressure transducer 325 measures residual pressure in the manifold 327 and the three bladders 303A, 303B, 303C. The first valve 323A functions as a "vent valve" for venting air from each bladder out of the circuit. In the illustrated embodiment, each valve 323A, 323B, 323C is a 2-way/2-position, normally closed, solenoid valve. These valves include two ports, an inlet port and an outlet port, and are closed until the valve is energized. The valves 323A, 323B, 323C could also be other types of valves. Parts of the circuit 301 generally corresponding to those of the circuit 1 will be given the same number, plus "300."

During a vent phase, the controller 305 uses the first valve 323A to control the residual pressure in the manifold 327 and the three bladders 303A, 303B, 303C. During compression treatment, the bladders 303A, 303B, 303C and manifold 327 may all be open to each other or, in certain instances, may be controlled for timed operation during treatment. For example, the second valve 323B and the third valve 323C can be instructed by the controller 305 to remain open during venting. The controller 305 can open and close the first valve 323A to control the residual pressure in all three bladders during the vent phase. The controller 305 can also instruct the second valve 323B and the third valve 323C to remain open during venting and open and close the first valve 323A. While this configuration does not allow independent control of the residual pressure in each bladder 303A, 303B, 303C,this configuration can be implemented with a single pressure transducer 325, which reduces cost as compared to implementations requiring additional pressure transducers.

The circuit 301 can also be operated by keeping only the vent valve 323A open during the vent phase and independently opening and closing the second and third valves 323B, 323C. In these embodiments, when the third valve 323C is closed and the second valve is opened and closed by the controller 305, the pressure in the first and second bladders 303A, 303B will normalize to the pressure in the manifold 327 and the residual pressure in the first and second bladders will be the same. When the controller 305 closes the second valve 323B and indexes to the third valve 323C, the opening and closing of the third valve will cause the pressure in the third bladder 303C to normalize to the pressure in the manifold 327, causing the residual pressure in the first and third bladders 303A, 3030 to be the same. This pressure may be the same or different from the pressure in the second bladder 303B. Valves 323A, 323B, 323C can be normally open or normally closed, depending on the length of the vent time compared to compression treatment time, to optimize valve power consumption.

Figure 6:
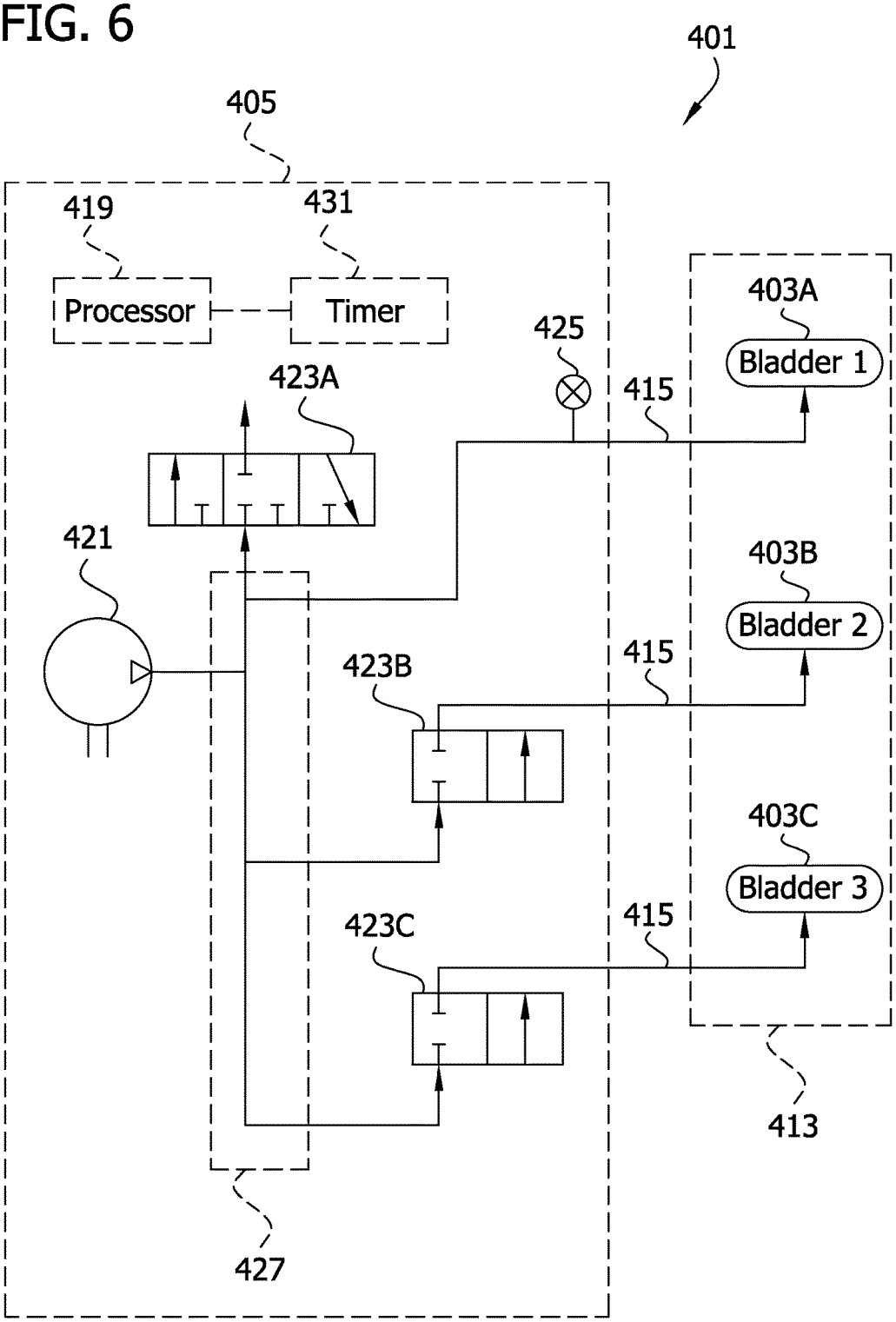
FIG. 6 is a schematic of another embodiment of a compression device including a valve controlling pressure in a common manifold and dedicated valves for certain bladders.

Referring to FIG. 6, a pneumatic circuit 401 is similar to the circuit 301 (FIG. 5) except the vent valve 323A of circuit 301 is replaced with a proportional control vent valve 423A. Parts of the circuit 401 generally corresponding to those of the circuit 1 will be given the same number, plus "400."

In the illustrated embodiment, the proportional control valve 423A is a 3-way/3-position, piezo valve. However, the valve could be a 3-way/2-position, piezo valve (not shown) or any other suitable proportional control valve. A proportional valve such as the valve 423A can be partially opened and closed to vary the amount and rate of fluid passing through the valve. The controller 405 can control the degree to which the valve 423A is opened during the vent phase to control the residual pressure in the bladders 403A, 403B, 403C. The controller 405 may partially open the vent valve 423A so the rate at which air is vented from the bladders 403A, 403B, 403C is proportional to the difference between a measured pressure in the bladders/manifold 427 and a desired residual pressure. Additionally or alternatively, the controller 405 may partially open the vent valve 423A so that the rate at which the air is vented from the bladders/manifold is proportional to a rate of change of the pressure in the bladders/manifold. As compared to a conventional solenoid valve, proportional control using the valve 423A uses less power and can facilitate a smoother transition between the therapeutic compression pressure in the bladders 403A, 403B, 403C and the desired residual pressure. Additionally or alternatively, proportional control using the valve 423A can modify the residual pressure in the bladders 403A, 403B, 403C from cycle to cycle as needed. As compared to solenoid valves, this valve does not need to be closed or opened repeatedly to control residual pressure.

Figure 7:
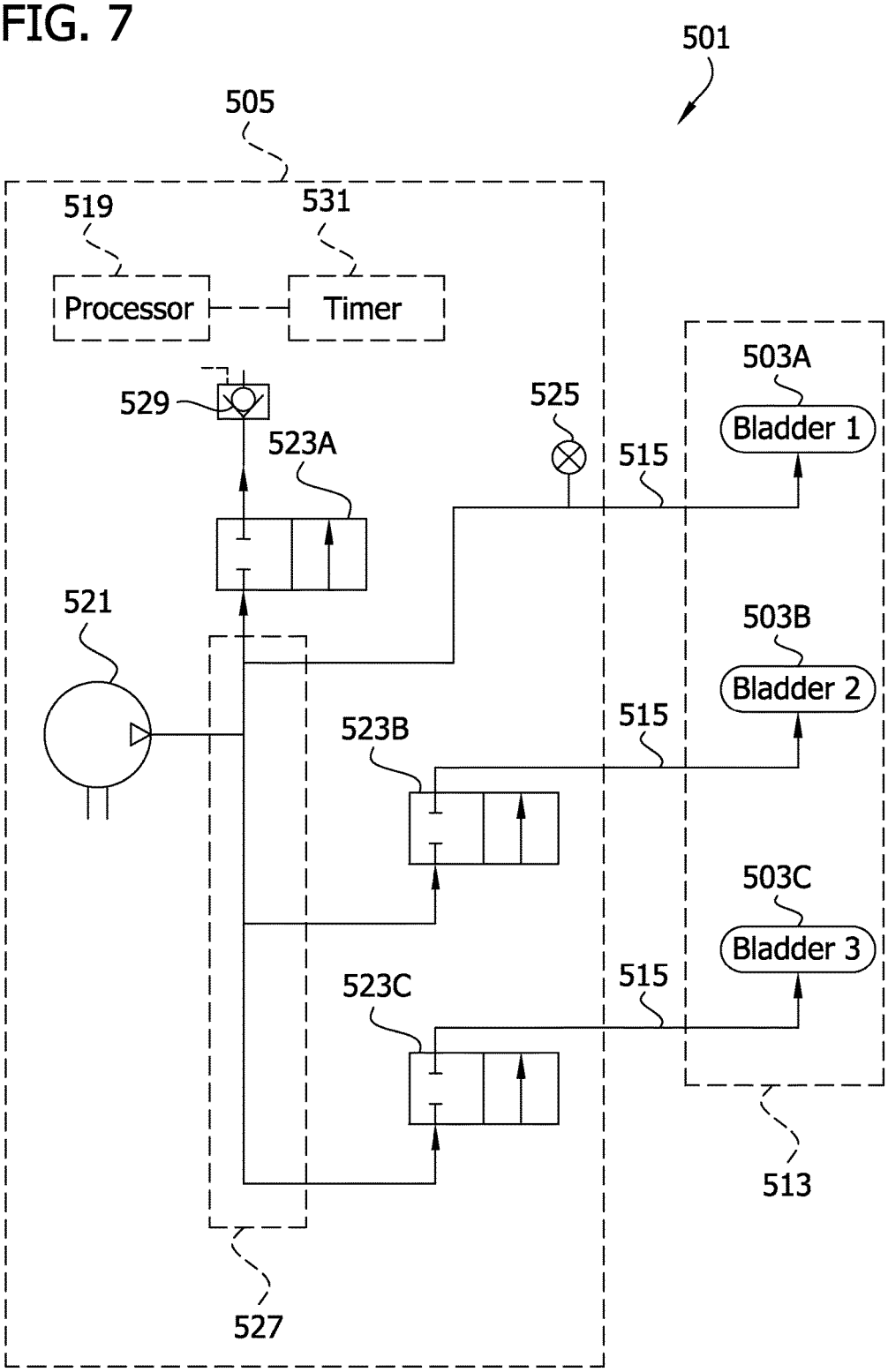
FIG. 7 is a schematic of a compression device including a passive check valve.

Referring to FIG. 7, a pneumatic circuit 501 is similar to the circuit 301 (FIG. 5) except a passive check valve 529 is downstream from a vent valve 523A. The controller 505 controls the check valve 529 to control the residual pressure in each bladder 503A, 503B, 503C. Parts of the circuit 501 generally corresponding to those of the circuit 1 will be given the same number, plus "500."

During the vent phase, when the controller 505 opens the vent valve 523A, air passes through the check valve 529 until pressure in the manifold 527 drops below a check valve cracking pressure (e.g., a pressure set during manufacture of the check valve). The cracking pressure can be selected, for example, based on desired residual pressure in the bladders 503A, 503B, 503C. When the pressure in the manifold 527 drops below the cracking pressure of the check valve 529, the check valve closes, causing pressure in the manifold to increase. When the pressure in the manifold 527 rises to a level greater than the cracking pressure, the check valve 529 opens, reducing pressure in the manifold. Thus, the check valve 529 controls residual pressure in the bladders 503A, 503B, 503C through its cracking pressure.

Referring again to FIG. 3, a passive check valve (not shown) can be added to the outlet of each valve 223A, 223B, 223C of the circuit 201 (e.g., between the manifold 227 and each valve). By using three check valves, each bladder 203A, 203B, 203C can be controlled to a common or different residual pressure. Because the check valves are passive, no power is consumed to control the residual pressure. In these embodiments, in which the cracking pressure of the check valve is fixed, the residual pressure for the bladder is a constant value.

Figure 8:
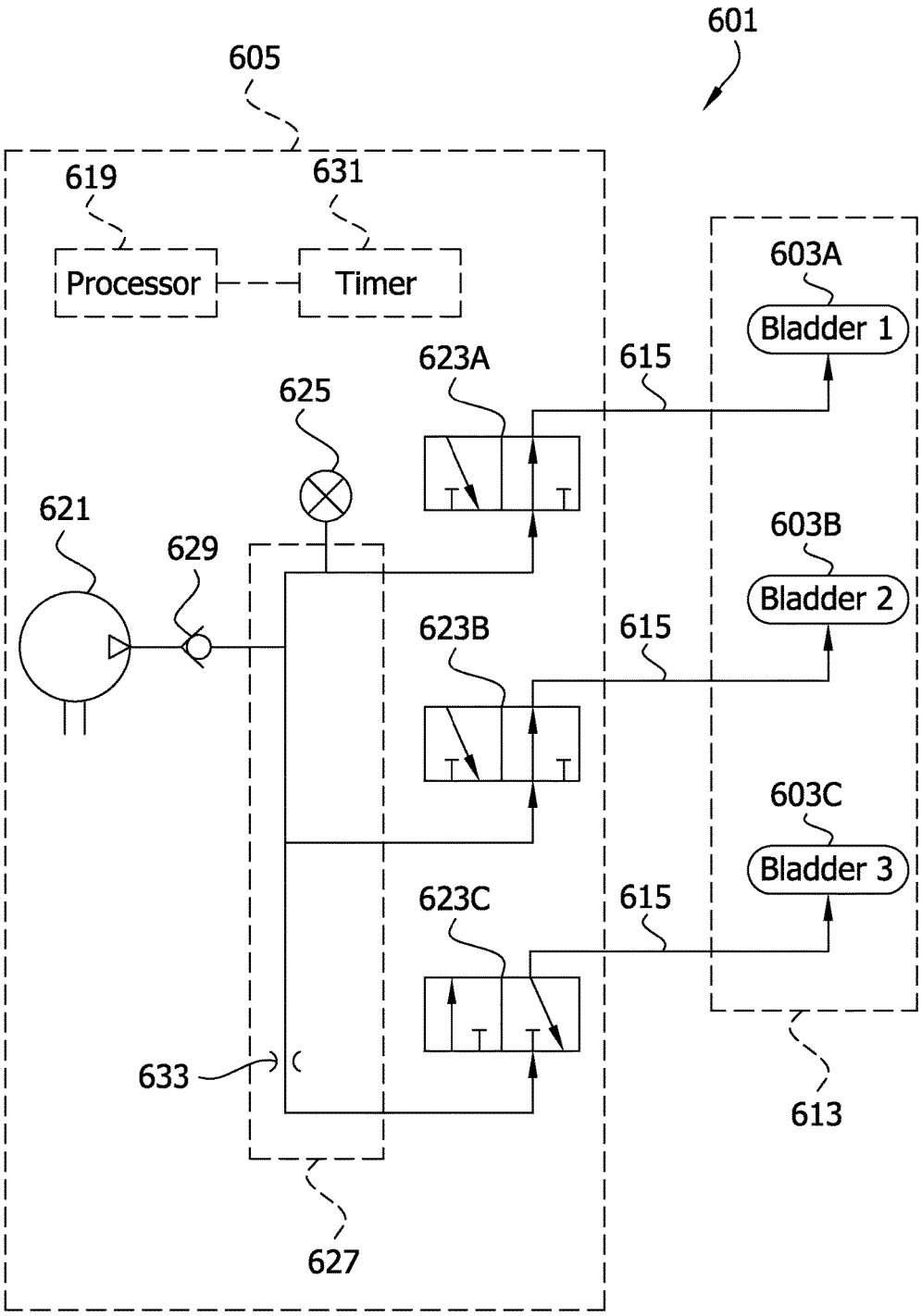
FIG. 8 is a schematic of a compression device including normally open and normally closed valves.

Referring to FIG. 8, a pneumatic circuit 601 is similar to the circuit 101 (FIG. 3) except valves 623A and 623B are 3-way/2-position, normally open, solenoid valves. Parts of the circuit 601 generally corresponding to those of the circuit 1 will be given the same number, plus "600." Valve 623C is a 3-way/2-position, normally closed, solenoid valve. Valves 623A, 623B, 623C are associated with bladders 603A, 603B, 603C, respectively. A check valve 629 is disposed between the air supply 621 and the manifold 627. The bladder 603A can apply compression to a subject's ankle, the bladder 603B can apply compression to a subject's calf, and the bladder 603C can apply compression to the subject's thigh. The 3-way/2-position valves associated with the bladders 603A, 603B (e.g., bladders disposed about the ankle and the calf of a patient's leg) allow residual pressure to be held in these bladders between inflation phases. An orifice 633 in the manifold 627 may provide a fail-safe mechanism to vent fluid from the bladders 603A, 603B, 603C. The orifice 633 is a small opening in the manifold 627 to help vent the manifold in case valves fail during the inflation cycle. The orifice 633 could be, for example, about 0.005 inches in diameter to about 0.2 inches in diameter.

It will be apparent that modifications and variations are possible without departing from the scope of the disclosure.

When introducing elements of the present invention or the preferred embodiments(s) thereof, the articles "a", "an", "the", and "said" are intended to mean that there are one or more of the elements. The terms "comprising", "including", "having" are intended to be inclusive and mean that there may be additional elements other than the listed elements.

In view of the above, it will be seen that several objects are achieved and other advantageous results attained.

As various changes could be made in the above constructions and methods without departing from the scope of this disclosure, it is intended that all matter contained in the above description and shown in the accompanying drawings shall be interpreted as illustrative and not in a limiting sense.

What is claimed is:

1. A method of controlling a compression device, the method comprising:

during an inflation phase, delivering pressurized fluid from a source of pressurized fluid to a first inflatable bladder disposed about a portion of a subject's body;

during a vent phase, venting the pressurized fluid from the first inflatable bladder to atmosphere by opening a first valve to a venting position, the first valve being free of a check valve;

measuring fluid pressure in the first inflatable bladder during said venting; and based at least in part on the measured fluid pressure, during the vent phase, moving the first valve to a non-venting position when a predetermined residual pressure in the first inflatable bladder is detected in said step of measuring fluid pressure; and after moving the first valve to the non-venting position when the predetermined residual pressure is detected, continuing to measure fluid pressure in the first inflatable bladder and based at least in part on the pressure values measured in said continued measuring of fluid pressure in the first bladder, moving the first valve between the venting position and the non-venting position to maintain fluid pressure in the first inflatable bladder within a desired residual pressure range around the predetermined residual pressure, the first inflatable bladder being in fluid communication with the source of pressurized fluid when the first valve is moved to the non-venting position, the non-venting position occurring during the vent phase of the first inflatable bladder when the source of pressurized fluid is not activated to inflate the first inflatable bladder, wherein during the vent phase after the desired residual pressure is reached, the first inflatable bladder is placed in fluid communication with the source of pressurized fluid causing an increase in the fluid pressure in the first inflatable bladder toward an upper end of the desired residual pressure range, and after placing the first inflatable bladder in fluid communication with the pressurized source, placing the first inflatable bladder in fluid communication with atmosphere causing a decrease in the fluid pressure in the first inflatable bladder toward a lower end of the desired residual pressure range.

2. The method as set forth in claim 1, wherein the desired residual pressure range extends from 1 to 10 mmHg.

3. The method as set forth in claim 1, wherein the first valve is selectively closed and selectively reopened at a regular time interval to maintain fluid pressure in the first inflatable bladder with the desired residual pressure range.

4. The method as set forth in claim 3, wherein the regular time interval is 200 ms.

5. The method as set forth in claim 1, wherein said measuring fluid pressure comprises receiving a signal from a pressure transducer in fluid communication with the first inflatable bladder.

6. The method as set forth in claim 1, further comprising during respective inflation phases, delivering pressurized fluid from the source of pressurized fluid to second and third inflatable bladders, the second and third inflatable bladders having associated second and third valves, each of the first, second, and third inflatable bladders disposed about a respective portion of the subject's body;

during respective vent phases, venting the first, second, and third bladders by independently moving first, second, and third valves to respective venting positions;

measuring fluid pressure in the first, second and third inflatable bladders during said venting;

based at least in part on the measured fluid pressure, during the vent phases, independently moving the first, second and third valves to respective non-venting positions when respective predetermined residual pressures in the first, second and third inflatable bladders are sensed in said step of measuring fluid pressure; and after the first, second and third valves are moved to the non-venting positions when the respective predetermined residual pressures are detected, continuing to measure fluid pressure in the first, second and third inflatable bladders and based at least in part on the pressure values measured during said continued measuring of fluid pressure in the first, second and third inflatable bladders, independently moving the first, second and third valves between the respective venting positions and the respective non-venting positions to maintain fluid pressure in the respective first, second, and third bladders within a respective desired residual pressure range around the respective predetermined residual pressure, the non-venting positions occurring during the vent phases of the first, second, and third inflatable bladders when the source of pressurized fluid is not activated to inflate the bladders.

7. The method as set forth in claim 6, further comprising measuring fluid pressure in each of the first, second, and third bladders with a single pressure transducer in fluid communication with the first, second, and third bladders.

8. The method as set forth in claim 6, wherein venting the first, second, and third bladders comprises sequentially opening the first, second, and third valves.

9. The method as set forth in claim 6, wherein venting the first, second, and third bladders comprises simultaneously opening the first, second, and third valves.

* * * * *